US005715512A

United States Patent [19]

Kumagai

[11] Patent Number: 5,715,512

[45] Date of Patent: Feb. 3, 1998

[54] APPARATUS AND METHOD FOR REMOVING RESIDUAL DEVELOPER REMAINING ON A PHOTOSENSITIVE ELEMENT

[75] Inventor: Minoru Kumagai, Tokyo, Japan

[73] Assignee: NEC Corporation, Tokyo, Japan

[21] Appl. No.: 634,620

[22] Filed: Apr. 18, 1996

[30] Foreign Application Priority Data

Apr. 20, 1995 [JP] Japan ..... 7-94998

[51] Int. Cl.[6] ..... G03G 13/00; G03G 21/00

[52] U.S. Cl. ..... 399/349; 15/1.51; 347/55; 399/35; 430/125

[58] Field of Search ..... 399/35, 347, 349; 430/125; 361/214; 15/1.51; 347/55

[56] References Cited

U.S. PATENT DOCUMENTS

| | | | |
|---|---|---|---|
| 4,252,433 | 2/1981 | Sullivan | 15/1.51 X |
| 4,478,510 | 10/1984 | Fuji et al. | 347/55 |
| 4,615,613 | 10/1986 | Garsin | 430/125 X |
| 4,743,926 | 5/1988 | Schmidlin et al. | 347/55 |
| 4,755,837 | 7/1988 | Schmidlin et al. | 347/55 |
| 4,761,674 | 8/1988 | Ogura | 399/35 |
| 4,956,677 | 9/1990 | Akiyama | 430/125 X |
| 5,030,999 | 7/1991 | Lindblad et al. | 399/349 |
| 5,119,144 | 6/1992 | Hada et al. | 15/1.51 X |
| 5,500,969 | 3/1996 | Bonislawski Jr. | 15/1.51 |

FOREIGN PATENT DOCUMENTS

| | | |
|---|---|---|
| 60-69677 | 4/1985 | Japan . |
| 5-94082 | 4/1993 | Japan . |

*Primary Examiner*—Arthur T. Grimley
*Assistant Examiner*—Sophia S. Chen
*Attorney, Agent, or Firm*—Young & Thompson

[57] ABSTRACT

In an electrophotographic image forming machine, an alternating current (AC) voltage is applied by an AC electric source with a constant frequency to a conductive wire and an electrode plate so that an electric field whose direction is inverted in synchronization with the frequency occurs. Consequently, the residual developer remaining on the front face of a photosensitive element vibrates and floats off the photosensitive element. A developer collecting roller is charged to the polarity electrically opposite to the polarity of the residual developer by application of a bias voltage from a direct current (DC) electric source. The residual developer separated from the front face of the photosensitive element is sucked and collected by the developer collecting roller with an electrostatic power developed between the developer collecting roller and the residual developer.

17 Claims, 2 Drawing Sheets

APPARATUS AND METHOD FOR REMOVING RESIDUAL DEVELOPER REMAINING ON A PHOTOSENSITIVE ELEMENT

BACKGROUND OF THE INVENTION

1. Field of the Invention

The present invention relates to an apparatus and method for removing the developer remaining on a belt-shaped photosensitive element in an electrophotographic type image forming machine such as an electrophotographic printer or a copying machine.

2. Description of the Related Art

For image forming machines using electrophotography, such as an electrophotographic printer or a copying machine, a wide variety of machines are known, but these share a common sequence of basic image forming processes. Namely, in the image forming processes, the residual electric charge on the surface of a photosensitive element is removed, then the photosensitive element surface is charged. Next, a latent image is formed by exposure, and the latent image is developed by adhering a developer to the photosensitive element. The developed image is then transferred onto a recording sheet, and fixed on the recording sheet. Finally, the developer remaining on the photosensitive element is removed.

For the aforementioned sequence of image forming processes, it is impossible to transfer all of the developer adhering on the photosensitive element onto the recording sheet because of influences such as operating circumstances, for example, temperature or humidity, or vibration produced during operation. About 10 to 20% of the developer is not transferred onto the recording sheet and remains on the photosensitive element. If the next image forming process were performed with such residual developer adhering to the photosensitive element, then a conspicuous image defect would occur.

A cleaning unit for removing the developer remaining on the photosensitive element, therefore, is indispensable to the current electrophotographic image forming machine.

In the cleaning unit presently used for this purpose, the blade-type cleaning unit is conventionally used. In the blade-type cleaning unit, a rubber blade is pressed against the surface of the photosensitive element to remove the residual developer by mechanical force. Here, polyurethane rubber, whose ozone resistance and wear resistance are excellent, is used for forming a rubber blade whose edge portion has an accurate angle and straightness.

This conventional cleaning unit is advantageous in that it is structurally simple and inexpensive, and its ability to remove the residual developer is high. However, the cleaning unit has the problem that its life is short, because the rubber blade is easily worn away. In addition, since the rubber blade is pressed against the photosensitive element with a strong force at all times, small amounts of residual developer are thereby pressed against the photosensitive element. This causes a so-called filming phenomenon, and consequently, there is the problem that the life of the photosensitive element is shortened. Furthermore, when the conventional cleaning unit is applied to a belt-shaped photosensitive element, there is another problem that a member for opposing the pressure of the rubber blade is needed opposite the rubber blade on the rear face of the photosensitive element.

Another conventional cleaning unit is disclosed in Japanese Patent Application Laid-Open No. 60-69677. In this conventional cleaning unit, a brush roller with a free fabric mounted therein is disposed in the vicinity of the photosensitive element surface and is rotated at a high speed, and at the same time, the brush is charged by friction. The residual developer on the photosensitive element surface is removed by making use of the air flow produced by the rotation of the brush roller and the static electricity produced by frictional charging.

Although this conventional cleaning unit is long in life and is applicable to a belt-shaped photosensitive element having a jointed or stepped portion, high power is needed for its operation, and consequently, this conventional cleaning unit has another problem that the size of the image forming machine is increased.

Yet another conventional cleaning unit is disclosed in Japanese Patent Application Laid-Open No. 5-94082. This conventional cleaning unit has a developing roller performing to only development, but also removal of the developer remaining on the photosensitive element.

SUMMARY OF THE INVENTION

It is an object of the present invention to provide a structurally simple apparatus and method for removing the developer remaining on a photosensitive element.

It is another object of the present invention to provide an apparatus and method for removing the developer remaining on a photosensitive element, which has a long useful lifetime.

To achieve the above objects, the apparatus of the present invention forms an electric field around the photosensitive element and then collects the developer which floats off the photosensitive element.

BRIEF DESCRIPTION OF THE DRAWINGS

The above and other objects, features and advantages of the present invention will become more apparent from the following description taken in conjunction with the accompanying drawings, wherein.

DETAILED DESCRIPTION OF THE PREFERRED EMBODIMENTS

Figure 1:
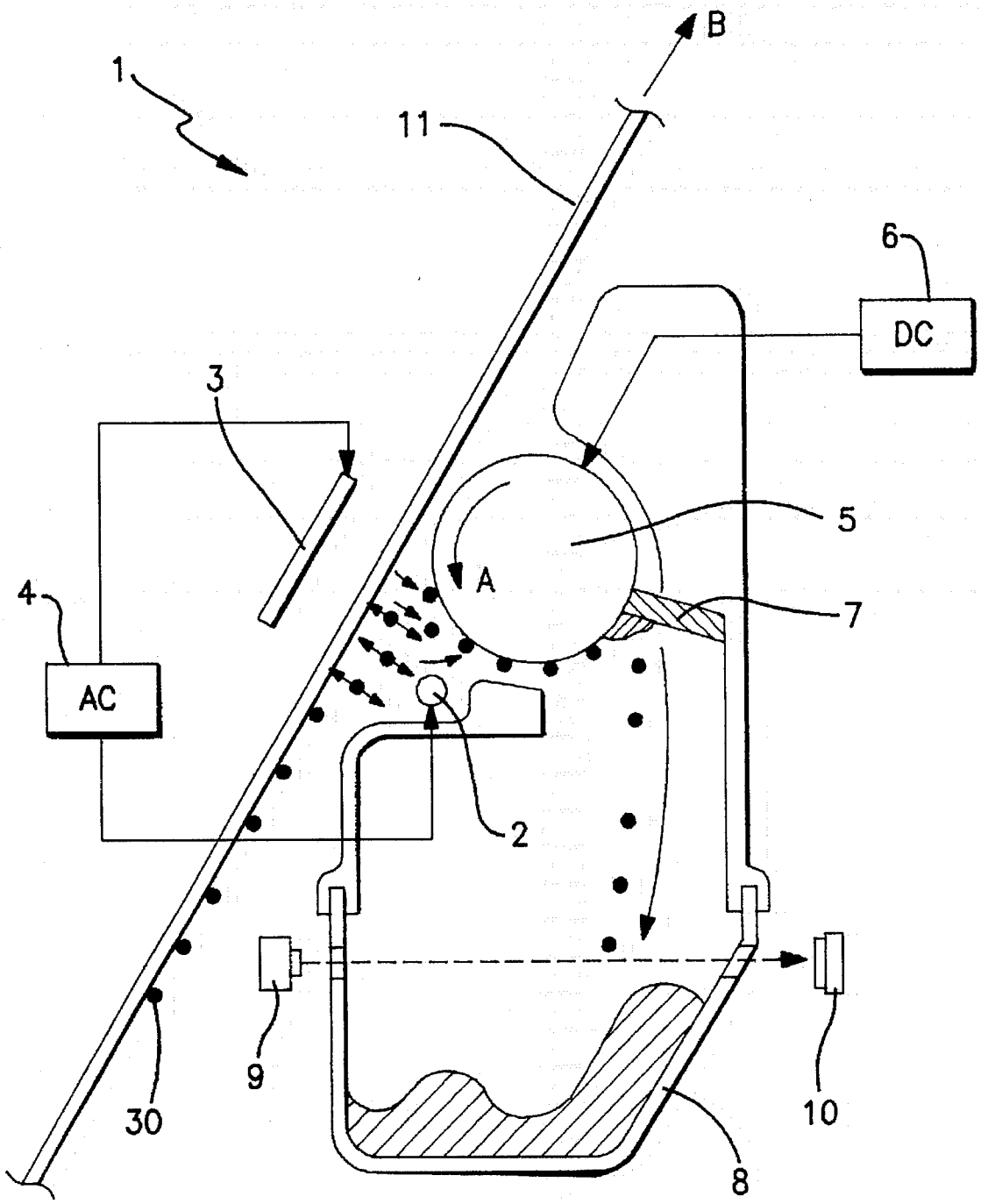
FIG. 1 is a diagram showing an embodiment of the present invention.

Referring to FIG. 1, a conductive wire 2 is disposed facing the front of a belt-shaped photosensitive element 11 on which developer is adhered, and an electrode plate 3 is disposed in a position opposed to the conductive wire 2 and facing the rear of the photosensitive element 11. The conductive wire 2 and the electrode plate 3 impart vibration to residual developer 30 remaining on the front face of the photosensitive element 11 so that the developer 30 floats off the photosensitive element 11, thereby separating the developer 30 from the photosensitive element 11. Here, the conductive wire 2 and the electrode plate 3 are provided in noncontacting relation to the photosensitive element 11. An alternating current (AC) source 4 applies an AC voltage with a constant frequency to the conductive wire 2 and the electrode plate 3 so that an electric field whose direction is inverted in synchronization with the frequency is generated, and consequently, the residual developer 30 remaining on the from face of the photosensitive element 11 vibrates and floats off the photosensitive element 11.

A developer collecting roller 5 is disposed facing the front of the photosensitive element 11 and is in noncontacting relation thereof. Further, the developer collecting roller 5 has an axis parallel to the front face of the photosensitive element 11 and rotates in the direction of arrow A. The developer collecting roller 5 is charged to the polarity electrically opposite to the polarity of the residual developer 30 by application of a bias voltage from a direct current (DC) source 6, and holds the residual developer 30 separated from the front face of fie photosensitive clement by electrostatic power developed between the developer collecting roller 5 and the residual developer 30.

A stripping blade 7, formed from material having high ozone resistance and wear resistance, such as polyurethane rubber, is held in contact with the surface of the developer collecting roller 5 at all times and scrapes away the residual developer 30 adhered to the developer collecting roller rotating in the direction of arrow A.

A developer storage section 8 stores the residual developer 30 scraped away from the developer collecting roller 5 by the stripping blade 7 and is constructed so that it is easily attachable with respect to a cleaning unit 1. A light emitter 9 and a sensor 10 are provided in mutually opposed positions across the developer storage section 8. The light emitter 9 emits a laser beam to the sensor 10 during file operation of the cleaning unit 1. The sensor 10 receives the laser light transmitted through the developer storage section 8 from the light emitter 9, and sends a signal to a control section when the residual developer 30 deposited in the developer storage section 8 obstructs the laser light emitted from the light emitter 9. The control section judges that the residual developer 30 has been stored in the developer storage section 8 up to a predetermined quantity when receiving the signal from the sensor 10, then steps the operation of the image forming machine, and causes a display panel to display that the residual developer 30 has been stored in the developer storage section 8 up to the predetermined quantity.

Next, the operation of an electrophotographic printer fitted with the cleaning unit of this embodiment will be described with reference to FIG. 1 and FIG. 2.

Figure 2:
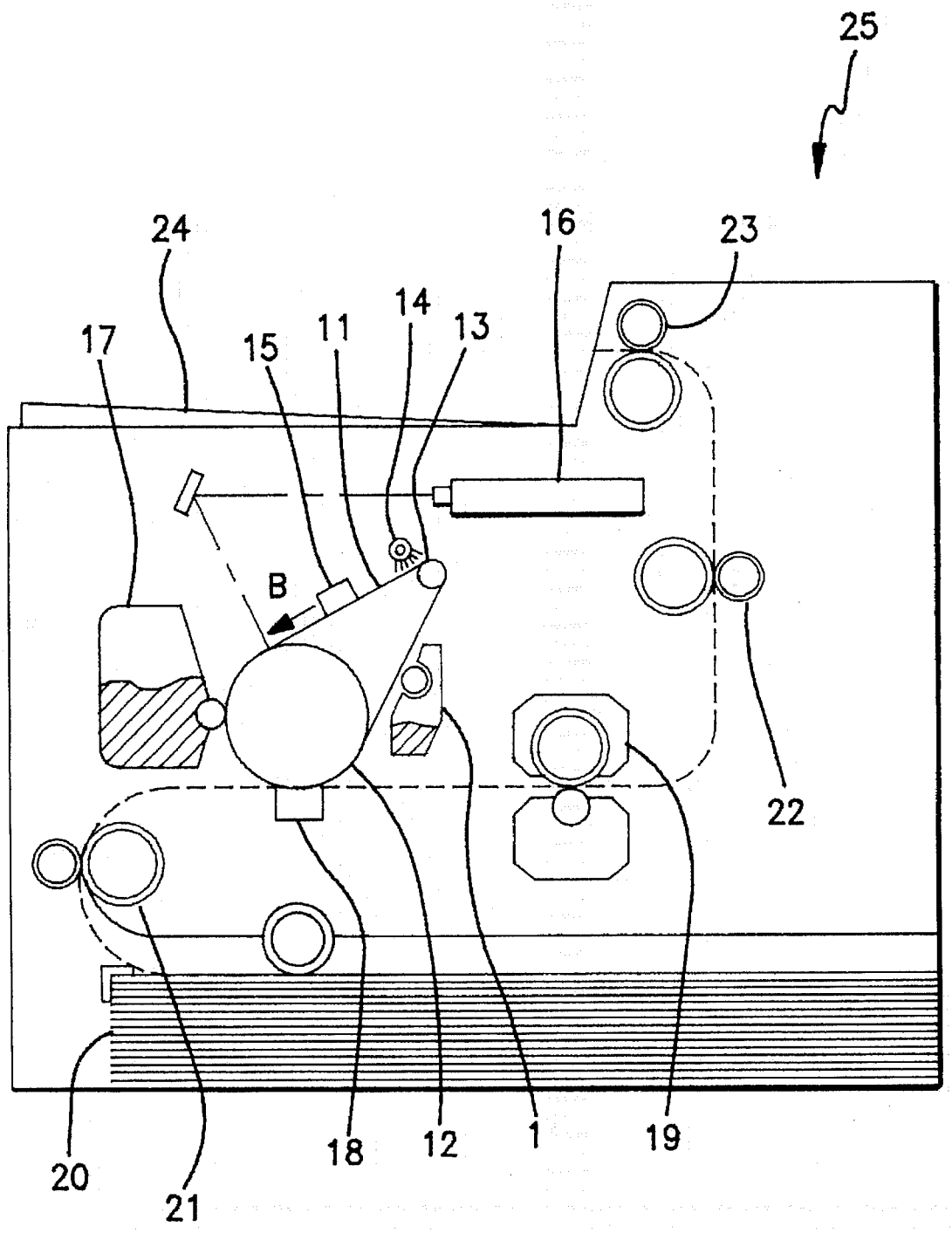
FIG. 2 is a diagram showing an electrophotographic printer using the embodiment of FIG. 1.

Referring to FIG. 2, the photosensitive element 11 has developer adhered on the front face thereof and carries it up to a transfer charger 18. The photosensitive element 11 is formed in a belt shape and is wound around rollers 12 and 13. The rollers 12 and 13 give a fixed tension to the photosensitive element 11 and drive the photosensitive element 11 in the direction of arrow B. A charge eraser 14 removes the residual electric charge remaining on the front face of the photosensitive element 11. A main charger 15 uniformly charges the front face of the photosensitive element 11 after the residual electric charge has been erased by the eraser 14. An exposure section 16 forms a latent image on file front face of the photosensitive element 11, based on image data transmitted from a high-order unit.

A developer section 17 performs a developing process to produce a developed image in which developer is applied to the latent image formed on the front face of the photosensitive element 11 by the exposure section 16. The transfer charger 18 transfers the developed image formed on the front face of the photosensitive element 11 to a sheet of recording paper. A fixing section 19 fixes the developed image transferred to the recording paper by the transfer charger 18 to the recording paper with heat and pressure. A recording-paper storage section 20 stores sheets of recording paper, and the recording paper supplied from the recording-paper storage section 20 is conveyed up to a tray 24 via the transfer charger 18 and the fixing section 19 by means of paper conveyor sections 21, 22, and 23. The paper conveyor sections 21, 22, and 23 are formed with rubber where the wear resistance and high coefficient of friction.

When image data is transmitted from a high-order unit to the electrophotographic printer 25, the recording-paper storage section 20 will send a sheet of recording paper. At the same time, the rollers 12 and 13 start to move the photosensitive element 11. At the same time as the start of the movement of the photosensitive element 11, the eraser 14 also starts to remove all electric charge remaining on the front face of the photosensitive element 11. Subsequently, the main charger 15 uniformly charges the front face of the photosensitive element 11 whose residual electric charge have been erased by the eraser 14. The photosensitive element 11, electrically charged by the main charger 15, reaches the exposure section 16 and then a latent image is formed based on the image data transmitted from the high-order unit. The latent image formed on the photosensitive element 11 becomes a developed image after applying developer from the developing section 17, and the developed image is transferred from the photosensitive element 11 to the recording paper by the transfer charger 18. The developed image transferred to the recording paper by the transfer charger 18 is fixed with heat and pressure by the fixing section 19. The developed image fixed to the recording paper by the fixing section 19 is conveyed by the paper conveyor sections 22 and 23 and is discharged to the tray 24.

After the developed image is transferred to the recording paper by the transfer charger 18, the photosensitive element 11 continues to move and then reaches the cleaning unit 1 that was described above with reference to FIG. 1. In the cleaning unit 1, at the time the loading edge of the developed image is transferred to the recording paper by the transfer charger 18, an AC voltage with a constant frequency is applied from the AC source 4 to the conductive wire 2 and the electrode plate 3. At the same time, a bias voltage is applied from the DC source 6 to the developer collecting roller 5, and consequently, the developer collecting roller 5 is rotated in the direction of the arrow A. The residual developer 30 not transferred to the recording paper by the transfer charger 18 but remaining on the photosensitive element 11, when passing between the conductive wire 2 and the electrode plate 3, is vibrated by the AC voltage therebetween and floats off the front face of the photosensitive element 11. There are some cases where the residual developer 30 initially does not start to vibrate by a variation in the electric field caused by the aforementioned AC voltage, because of the influence of a variation in the charged quantity or the influence of the change of the attraction force (Van der Waals force) between the developer and the photosensitive element which varies due to a difference in shape of the developer. Such a developer ultimately starts to vibrate and floats from the front face of the photosensitive element 11 by the AC electric field being continuously given, because the developer contacts with other developer particles starting to vibrate and therefore the attraction force with the photosensitive element is weakened. In this way, the residual developer 30 separated from the front face of the photosensitive element 11 is sucked by the developer collecting roller 5 receiving the bias voltage from the DC source 6 and adheres to the surface. The residual developer 30 adhering to the surface of the developer collecting roller 5 is scraped away by the stripping blade 7 and is stored in the developer storage section 8.

The quantity of the residual developer 30 stored in the developer storage section 8 increases, as the printing process of the electrophotographic printer 25 advances. However, the quantity of the residual developer 30 stored in the developer storage section 8 is monitored at all times by the light emitter 9 and the sensor 10 provided in the upper portion of the developer storage section 8. That is, the light emitter 9 emits laser light to the sensor 10 during the operation of the cleaning unit 1, and the sensor 10 receives the laser light transmitted through the developer storage section 8 from the light emitter 9 and, when the quantity of the residual developer 30 stored in the developer storage section 8 is increased and obstructs the laser light emitted from the light emitter 9, then the sensor 10 will send a signal to the control section. The control section judges that the residual developer 30 has been stored in the developer storage section 8 up to a predetermined quantity when receiving the signal from the sensor 10, then stops the operation of the electrophotographic printer, and causes a display panel to display that condition. For this reason, the portion of the developer storage section 8 facing the light emitter 9 and the sensor 10, are formed from material transparent to laser light, such as acrylic resin.

An operator detaches the developer storage section 8 from the cleaning unit 1, based on the display of the display panel, and exchanges it for a new one. Note that particles of developer are easily scattered in the exchange process. Therefore, a detachable cover is put on the developer storage section 8 when exchanged and the developer storage section is removed. Then the developer can be prevented from being scattered and contaminating the electrophotographic printer. In addition, by removing only the stored developer and reusing the removed developer storage section, resources can be saved and cost can be reduced.

While the invention has been described with reference to a preferred embodiment thereof, the invention is not to be limited to the details given herein, but may be modified within the spirit and scope of the appended claims.

I claim:

1. A method for removing residual particulate developer remaining on a photosensitive element, comprising the steps of:

forming an electric field whose direction is inverted in synchronization with a predetermined frequency around said photosensitive element; and collecting said developer which floats off said photosensitive element under influence of said electric field.

2. An apparatus for removing residual particulate developer remaining on a photosensitive element, comprising:

means for forming an electric field around said photosensitive element; and means for collecting developer which floats off said photosensitive element under influence of said electric field, wherein said forming means comprises electrodes disposed such that said photosensitive element is disposed between said electrodes; and means for applying an alternating current voltage with a predetermined frequency to said electrodes, and wherein said electrodes comprise a conductive wire disposed on a first side of said photosensitive element on which said developer adheres, and an electrode plate disposed on a second side of said photosensitive element, said second side being opposite to said first side.

3. An apparatus for removing residual particulate developer remaining on a photosensitive element, comprising:

means for forming an electric field having a direction inverted in synchronization with a predetermined frequency around said photosensitive element; and means for collecting developer which floats off said photosensitive element under influence of said electric field.

4. The apparatus as claimed in claim 3, wherein said forming means comprises:

electrodes disposed such that said photosensitive element is disposed between said electrodes; and means for applying an alternating current voltage with a predetermined frequency to said electrodes.

5. The apparatus as claimed in claim 4, wherein said electrodes are disposed out of contact with said photosensitive element.

6. The apparatus as claimed in claim 3, wherein said collecting means comprises:

a collecting member disposed on a first side of said photosensitive element on which said developer adheres; and means for charging said collecting member to an electric polarity opposite to an electric polarity of said developer.

7. The apparatus as claimed in claim 6, wherein said collecting member is a roller having an axis parallel to said first side of said photosensitive element.

8. The apparatus as claimed in claim 7, further comprising:

a stripping blade for removing developer adhering to said roller; and storage means for storing developer removed by said stripping blade.

9. The apparatus as claimed in claim 8, wherein said stripping blade contacts said roller.

10. The apparatus as claimed in claim 6, wherein said charging means is a direct current power supply for applying a bias voltage to said collecting member.

11. The apparatus as claimed in claim 6, wherein said collecting member is disposed out of contact with said photosensitive element.

12. The apparatus as claimed in claim 6, further comprising:

means for removing developer collected on said collecting member; and means for storing developer removed by said removing means.

13. The apparatus as claimed in claim 12, further comprising means for detecting an amount of developer stored by said storage means.

14. An apparatus for forming image, comprising:

a photosensitive element;

first removing means for removing electric charge remaining on said photosensitive element following an image-forming operation;

charging means for electrically charging said photosensitive element;

first forming means for forming a latent image on said photosensitive element;

developing means for applying particulate developer to said latent image formed on said photosensitive element to produce a developed image;

transfer means for transferring said developed image formed on said photosensitive element to a recording sheet; and second removing means for removing residual developer remaining on said photosensitive element, wherein said second removing means comprises second forming means for forming an electric field adjacent said photosensitive element; and collecting means for collecting said developer which floats off said photosensitive element;

wherein said second forming means further comprises electrodes disposed on opposite sides of said photosensitive element, and means for applying an alternating current voltage with a predetermined frequency to said electrodes.

15. The apparatus as claimed in claim 14, wherein said collecting means comprises:

a collecting member disposed on a first side of said photosensitive element on which said developer adheres; and means for charging said collecting member to an electric polarity opposite to an electric polarity of said developer.

16. The apparatus as claimed in claim 15, further comprising:

third removing means for removing developer collected on said collecting member; and means for storing developer removed by said third removing means.

17. The apparatus as claimed in claim 16, further comprising:

means for detecting an mount of developer stored by said storage means.

* * * * *